US008111003B2

(12) United States Patent
Park

(10) Patent No.: US 8,111,003 B2
(45) Date of Patent: Feb. 7, 2012

(54) BACKLIGHT ASSEMBLY, DISPLAY APPARATUS HAVING THE SAME AND CONTROL METHOD THEREOF

(75) Inventor: Seong-ho Park, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 517 days.

(21) Appl. No.: 12/271,546

(22) Filed: Nov. 14, 2008

(65) Prior Publication Data

US 2009/0128047 A1 May 21, 2009

(30) Foreign Application Priority Data

Nov. 19, 2007 (KR) ..... 10-2007-0118074
May 9, 2008 (KR) ..... 10-2008-0043136

(51) Int. Cl.
*G05F 1/00* (2006.01)
*H05B 41/16* (2006.01)

(52) U.S. Cl. ..... 315/291; 315/246

(58) Field of Classification Search ..... 315/291, 315/307, 209 R, 244, 224, 246, 276
See application file for complete search history.

(56) References Cited

U.S. PATENT DOCUMENTS 5,859,489 A * 1/1999 Shimada ..... 310/318
5,923,546 A * 7/1999 Shimada et al. ..... 363/40
6,044,003 A * 3/2000 Toshinari et al. ..... 363/97
6,943,503 B2 * 9/2005 Ozasa et al. ..... 315/224
7,414,609 B2 * 8/2008 Ahn et al. ..... 345/102

* cited by examiner

*Primary Examiner* — Douglas W Owens
*Assistant Examiner* — Minh D A
(74) *Attorney, Agent, or Firm* — Sughrue Mion, PLLC

(57) ABSTRACT

A backlight assembly with a light source unit, includes: a drive signal generator which generates a switching drive signal on the basis of a predetermined drive frequency and a feedback power fed back from the light source unit; a switching unit which outputs a power to the light source unit in response to the switching drive signal; and a controller which decreases the drive frequency if the feedback power is higher than a predetermined critical value.

19 Claims, 6 Drawing Sheets

BACKLIGHT ASSEMBLY, DISPLAY APPARATUS HAVING THE SAME AND CONTROL METHOD THEREOF

CROSS-REFERENCE TO RELATED APPLICATION

This application claims priority from Korean Patent Applications No. 10-2007-0118074, filed on Nov. 19, 2007 and No. 10-2008-0043136, filed on May 9, 2008 in the Korean Intellectual Property Office, the disclosures of which are incorporated herein by reference.

BACKGROUND OF INVENTION

1. Field of Invention

Apparatuses and methods consistent with the present invention relate to a backlight assembly, a display apparatus having the same and a control method thereof, and more particularly to a backlight assembly with a light source unit to be driven by an inverter, a display apparatus having the same and a control method thereof.

2. Description of the Related Art

A display apparatus with a liquid crystal display (LCD) panel includes a backlight assembly to emit light in the rear side of the LCD panel, and a backlight driver to drive the backlight assembly.

In general, the backlight driver includes an inverter that changes a level of input power and supplies it to the backlight assembly. Further, the inverter gets feedback from the backlight assembly with regard to current flowing in the backlight assembly and adjusts a duty ratio of a drive signal for supplying power on the basis of the feedback.

Meanwhile, the duty ratio of the inverter is varied according to the LCD panel, more specifically, according to combination of the LCD panel and the backlight assembly. If the duty ratio is low, there is a problem that heat is generated from a switch and a transformer in the inverter. If the duty ratio is lower than an optimum duty ratio of the maximum efficiency, the power has to increase so as to be transmitted from a primary coil of the transformer to a secondary coil, so that heat is generated due to increase of a peak current.

To solve these problems, the display apparatus uses a plurality of switching devices to radiate heat, but production costs increases due to the switching devices and the structure of the inverter becomes complicated.

SUMMARY OF THE INVENTION

Accordingly, it is an aspect of the present invention to provide a backlight assembly improved in heat generation with low production costs, a display apparatus having the same, and a control method thereof.

Another aspect of the present invention is to provide a backlight assembly capable of easily optimizing a duty ratio of an inverter, a display apparatus having the same, and a control method thereof.

The foregoing and/or other aspects of the present invention can be achieved by providing a backlight assembly with a light source unit, including: a drive signal generator which generates a switching drive signal on the basis of a predetermined drive frequency and a feedback power fed back from the light source unit; a switching unit which outputs a power to the light source unit in response to the switching drive signal; and a controller which decreases the drive frequency if the feedback power is higher than a predetermined critical value.

The drive signal generator may generate a triangle wave based on the drive frequency, the controller may include a first switch turned off if the feedback power is higher than the critical value, and a second switch allowing a predetermined current to flow toward the drive signal generator by turning on if the first switch is turned off, and the current input to the drive signal generator may decrease steepness of the triangle wave.

The drive signal generator may include a feedback inverting terminal through which the feedback power is inverted and output, and the first switch is connected to the feedback inverting terminal.

The controller further include a plurality of voltage division resistors connected between the feedback inverting terminal and the first switch to determine a power level at which the first switch remains turned off.

The feedback inverting terminal outputs power in inverse proportion to the feedback power.

The controller further includes a capacitor to turn on the second switch after a lapse of predetermined delay time after the first switch is turned off.

The controller further includes a resistor to adjust a level of the current input to the drive signal generator.

The foregoing and/or other aspects of the present invention can be achieved by providing a backlight assembly with a light source unit, including: a drive signal generator which generates a switching drive signal having a duty ratio variable depending on a feedback power fed back from the light source unit; a switching unit which outputs a power in response to the switching drive signal; and a controller which controls the drive signal generator to increase the duty ratio of the switching drive signal if the feedback power is higher than a predetermined critical value.

The drive signal generator may include a capacitor to generate a triangle wave based on a predetermined drive frequency, and the controller may increase the duty ratio of the switching drive signal by decreasing steepness of the triangle wave.

The controller may include a first switch turned off if the feedback power is higher than the critical value, and a second switch allowing a predetermined current to flow toward the drive signal generator by turning on if the first switch is turned off, and the current input to the drive signal generator may decrease the steepness of the triangle wave.

The foregoing and/or other aspects of the present invention can be achieved by providing a display apparatus including: a display unit which displays an image; a light source unit which illuminates the display unit; and a power supply which supplies power to the display unit and the light source unit, the power supply including a drive signal generator which generates a switching drive signal on the basis of a predetermined drive frequency and a feedback power fed back from the light source unit; a switching unit which outputs the power in response to the switching drive signal; and a controller which determines a duty ratio of the switching drive signal on the basis of the feedback power and decreases the drive frequency if the duty ratio of the switching drive signal is lower than an optimum value.

The drive signal generator may generate a triangle wave based on the drive frequency, the controller may include a first switch turned off if the feedback power is higher than the critical value, and a second switch allowing a predetermined current to flow toward the drive signal generator by turning on if the first switch is turned off, and the current input to the drive signal generator may decrease steepness of the triangle wave.

The controller further include a plurality of voltage division resistors to determine a power level at which the first switch remains turned off.

The controller further includes a resistor to adjust a level of the current input to the drive signal generator.

The controller further includes a capacitor to turn on the second switch after a lapse of predetermined delay time after the first switch is turned off.

The foregoing and/or other aspects of the present invention can be achieved by providing a method of controlling a backlight assembly with a light source unit, the method including: generating a switching drive signal using a triangle wave based on a predetermined drive frequency; supplying power to the light source unit in response to the switching drive signal; receiving a feedback power from the light source unit; and decreasing the drive frequency if the feedback power is higher than a predetermined critical value.

The decreasing the drive frequency may include decreasing steepness of the triangle wave if the feedback power is higher than the critical value.

BRIEF DESCRIPTION OF THE DRAWINGS

The above and/or other aspects of the present invention will become apparent and more readily appreciated from the following description of the exemplary embodiments, taken in conjunction with the accompanying drawings, in which.

DETAILED DESCRIPTION OF EXEMPLARY EMBODIMENTS OF THE INVENTION

Figure 1:
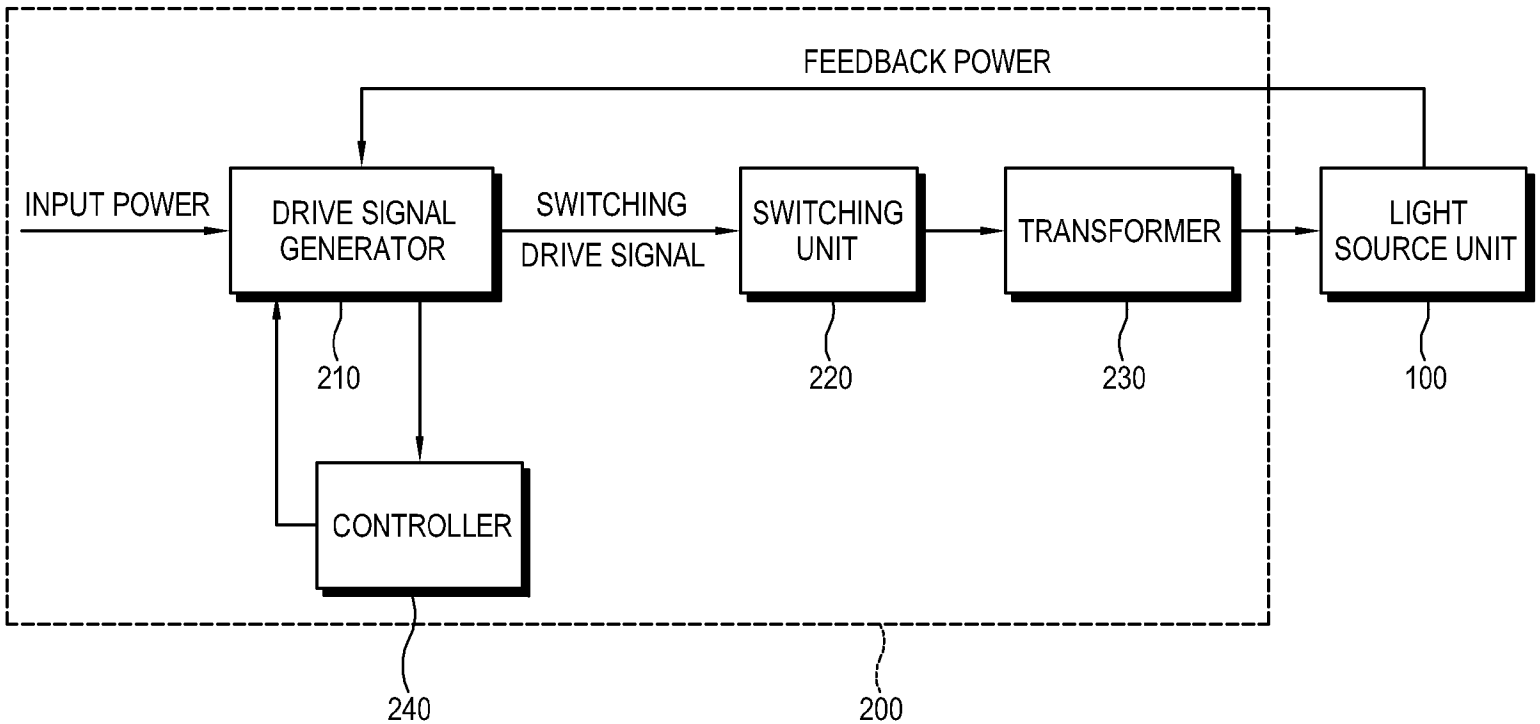
FIG. 1 is a control block diagram of a backlight assembly according to a first exemplary embodiment of the present invention.

Below, embodiments of the present invention will be described in detail with reference to accompanying drawings so as to be easily realized by a person having ordinary knowledge in the art. The present invention may be embodied in various forms without being limited to the embodiments set forth herein. Descriptions of well-known parts are omitted for clarity, and like reference numerals refer to like elements throughout.

Figure 2:
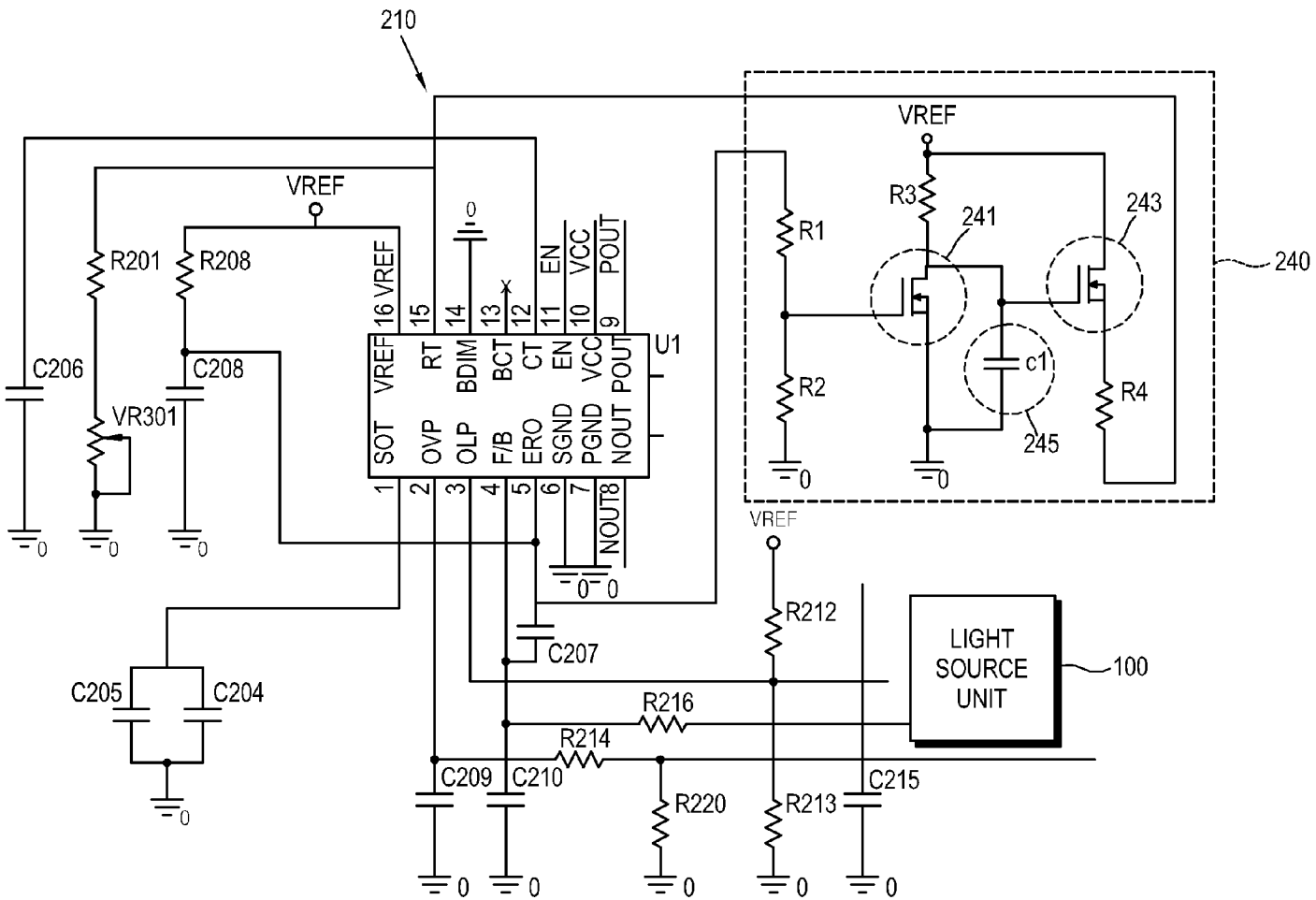
FIG. 2 is a circuit diagram of a drive signal generator and a controller in FIG. 1.

FIG. 1 is a control block diagram of a backlight assembly according to a first exemplary embodiment of the present invention, and FIG. 2 is a circuit diagram of a drive signal generator and a controller in FIG. 1. As shown therein, the backlight assembly includes a light source unit 100, and a light source driver 200 supplying drive power to the light source unit 100. In this embodiment, the backlight assembly is placed in a rear part of a liquid crystal display (LCD) panel or a large-sized image display and used as a light source to emit light.

The light source unit 100 may include a plurality of optical devices. Further, the light source unit 100 may include a line light source such as a cold cathode fluorescent lamp (CCFL) or a hot cathode fluorescent lamp (HCFL), or a point light source such as a light emitting diode (LED).

The light source driver 200 includes a drive signal generator 210, a switching unit 220, a transformer 230 and a controller 240. The light source driver 200 adjusts a level of external input power and supplies it to the light source unit 100. The light source driver 200 is generally called an inverter.

The drive signal generator 210 generates a switching drive signal on the basis of a predetermined drive frequency and a feedback power fed back from the light source unit 100. The switching drive signal includes a pulse width modulation (PWM) control signal for controlling the switching unit 220 connected to the drive signal generator 210. The drive signal generator 210 adjusts a duty ratio of the switching drive signal in order to adjust a level of the drive power supplied to the light source unit 100. In the present embodiment, the backlight assembly may be modularized as an independent device for emitting light to a display panel. In this case, the duty ratio of the switching drive signal may vary according to the light source unit 100 connected to the light source driver 200 or the display panel sharing power supply with the light source unit 100, or according to combination of the light source unit 100 and the display panel. In other words, even if the backlight assembly to be driven through the switching drive signal having an optimum duty ratio is connected to the display panel, the duty ratio may decrease according to the display panel. As the duty ratio decreases, a peak current increases since power to be output per unit time increases, so that the light source driver 200 may generate heat. The drive signal generator 210 generates the switching drive signal having the duty ratio variable according to control of the controller 240 in order to reduce the heat generation, which will be described below in more detail.

The drive signal generator 210 includes a microcomputer U1 with a plurality of terminals as shown in FIG. 2. The terminal of the microcomputer U1 is connected to a plurality of resistors or capacitors. The drive signal generator 210 generates a triangle wave to generate the switching drive signal, and the triangle wave is formed on the basis of a predetermined drive frequency. Generally the triangle wave is generated by changing a waveform of input alternating current (AC) power, and at this time differential/integral circuits with the resistor and the capacitors are used. Among the terminals of the microcomputer U1, a terminal connected to a resistor R201 and a terminal connected to a capacitor C206, which are related to generation of the triangle wave, will be called a resistor terminal RT and a capacitor terminal CT, respectively. Further, the microcomputer U1 includes a feedback terminal F/B to which the feedback power of the light source unit 100 is input, and a feedback inverting terminal ERO from which the feedback power input from the feedback terminal F/B is inverted and then output. Also, the microcomputer U1 internally includes an operator (not shown) provided between the feedback terminal F/B and the feedback inverting terminal ERO and inverting the input power. If the feedback power increases, the power of which level decreases is output from the feedback inverting terminal ERO via the operator. That is, the power is output from the feedback inverting terminal ERO in inverse proportion to the feedback power input to the feedback terminal F/B. Between the feedback terminal F/B and the feedback inverting terminal ERO is connected a capacitor C207 for stabilizing the feedback power. The switching drive signal generated in the microcomputer U1 is input to the switching unit 220 via a first output unit NOUT and a second output unit POUT.

The switching unit 220 includes a plurality of metal oxide semiconductor field effect transistors (MOS-FETs), and the connection and the number of MOS-FETs may be changed in various manner. The switching unit 220 is turned on/off by the switching drive signal output from the drive signal generator 210, and transmits the external input power to the light source unit 100. The switching unit 220 is turned on and off depending on the duty ratio of the switching drive signal. For example, if the duty ratio increases, a period of time during which the switching unit 220 is turned on increases and thus the amount of power supplied to the light source unit 100 increases.

The transformer 230 includes primary and secondary coils (not shown) and boosts up a voltage of the input power. When the duty ratio of the switching drive signal decreases, the amount of power that has to be supplied for a predetermined time is relatively increased as compared with that in the case of the optimum duty ratio, so that the current flowing in the transformer 230, particularly, in the primary coil increases, thereby generating heat.

The controller 240 controls the drive frequency to decreases when the feedback power is higher than a predetermined critical value. In the case that the drive frequency decreases, the amount of current transmitted to the switching unit 220 and the transformer 230 decreases so that the generation of heat decreases. As shown in FIG. 2, the controller 240 includes a first switch 241 connected to the feedback inverting terminal ERO, and a second switch 243 connected to the first switch 241. The first switch 241 and the second switch 243 may be also achieved by the MOS-FET like the switching unit 220. Further, the controller 240 includes voltage division resistors R1 and R2 to determine a power level at which the first switch 241 remains turned off. The voltage division resistors R1 and R2 includes a first resistor R1 connected between the feedback inverting terminal ERO and a control terminal of the first switch 241, and a second resistor R2 connected between the control terminal of the first switch 241 and a ground terminal. The first switch 241 is turned on or off depending on resistance ratio of the voltage division resistors R1 and R2. For example, suppose that the first switch 241 is turned on at a voltage of 1.2V and the first and second resistors R1 and R2 have the same resistance. In this case, if a voltage output from the feedback inverting terminal ERO is 2.4V or higher, a voltage of 1.2V or higher is applied to the control terminal of the first switch 241 to thereby turn on the first switch 241.

On the other hand, if the voltage output from the feedback inverting terminal ERO is lower than 2.4V, the first switch 241 is turned off. In this embodiment, if the feedback power fed back from the light source unit 100 has a level higher than the critical value, i.e., if the power output through the transformer 23 is higher than a certain amount, it means that the duty ratio of the switching drive signal does not reach the optimum duty ratio. Typically, the optimum duty ratio is set within a range not higher than 50%. Alternatively, the optimum duty ratio may be variously set in consideration of configuration of the switching unit 220. Thus, the critical value of the feedback power is determined as a value for determining whether the duty ratio of the switching drive signal is lower than the optimum duty ratio. Also, the voltage division resistors R1 and R2 may act as a factor on determining the critical value of the feedback power.

Input and output terminals of the first switch 241 are connected to a predetermined power source terminal VREF and a ground terminal, respectively, and a third resistor R3 is connected between the power source terminal VREF and the first switch 241. The second switch 243 has a control terminal connected between the third resistor R3 and the input terminal of the first switch 241, an input terminal connected to the power source terminal VREF, and an output terminal connected to the microcomputer U1 of the drive signal generator 210. If the first switch 241 is turned on, the second switch 243 is turned off because power supplied from the power source terminal VREF is consumed in the third resistor R3. On the other hand, if the first switch 241 is turned off, the second switch 243 is turned on by power from the power source terminal VREF. As the second switch 243 is turned on, the power from the power source terminal VREF, i.e., current is input to the microcomputer U1 that generates the switching drive signal via the second switch 243.

A capacitor (C1) 245 is connected between the control terminal of the second switch 242 and a ground terminal. The capacitor 245 delays signal transmission so that the second switch 243 is turned on after a lapse of predetermined delay time after the first switch 241 is turned off. Depending on capacitance of the capacitor 245 and resistance of the resistor R3 (multiply of the capacitance and the resistance corresponds to a time constant), a point of time to turn on the second switch 243 is determined, and thus a point of time to change the duty ration of the switching drive signal and the drive frequency is determined.

Also, the controller 240 further includes a fourth resistor R4 connected between the output terminal of the second switch 243 and the resistor terminal RT of the microcomputer U1. The fourth resistor R4 causes the level of current input to the microcomputer U1 to be adjusted, thereby adjusting the decrease of the drive frequency and the increase in the duty ratio of the switching drive signal.

Overall, the controller 240 operates as follows. When the feedback power fed back from the light source unit 100 is the critical value or below, it is determined that the switching drive signal is maintained in the optimum duty ratio. Thus, the first switch 241 is turned on. As the first switch 241 is turned on, the power from the power source terminal VREF is not supplied to the microcomputer U1 of the drive signal generator 210.

On the other hand, when the feedback power is higher than the critical value, the level of the power from the feedback inverting terminal ERO decreases. As the voltage level of the feedback inverting terminal ERO decreases, the first switch 241 is turned off, and the second switch 243 is turned on after the lapse of a certain delay time. When the second switch 243 is turned on, the power from the power source terminal VREF is input to the resistor terminal RT of the microcomputer U1 via the fourth resistor R4.

Figure 3:
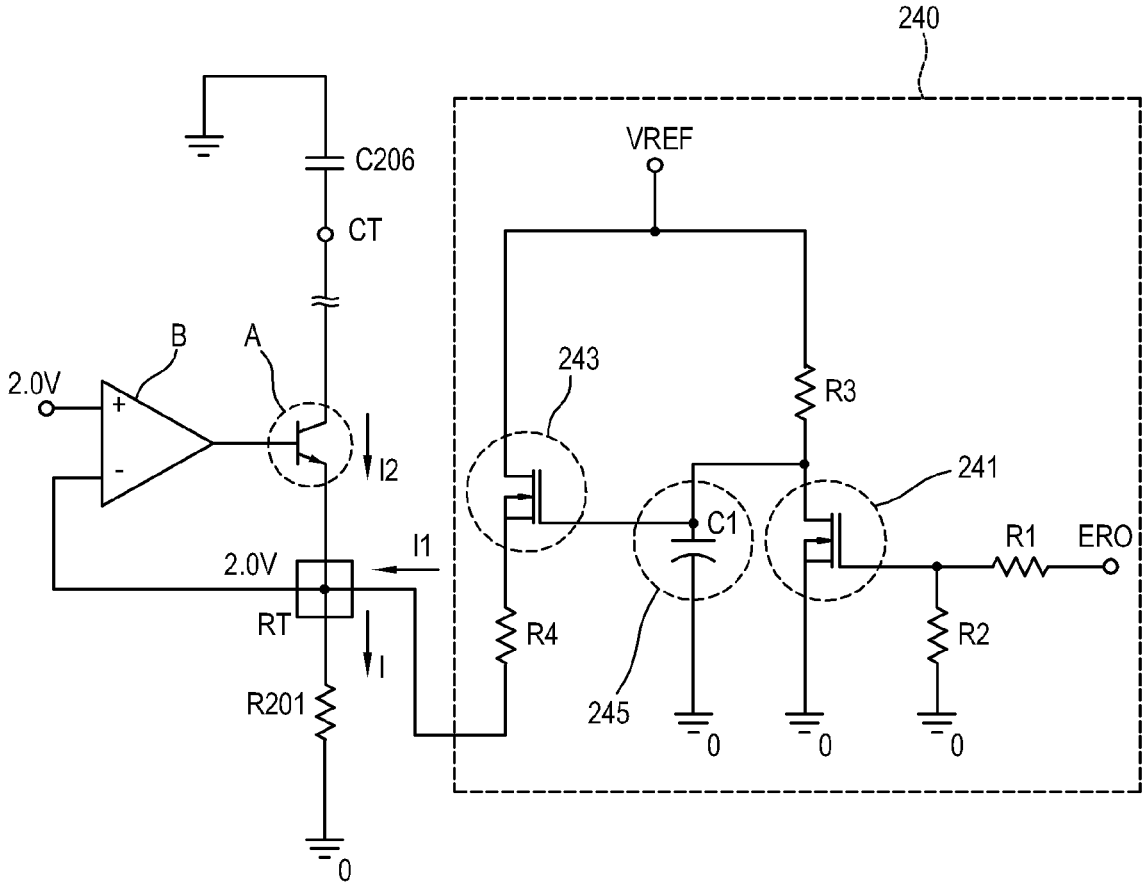
FIG. 3 is a circuit diagram for explaining a current change by the controller of FIG. 1.
Figure 4:
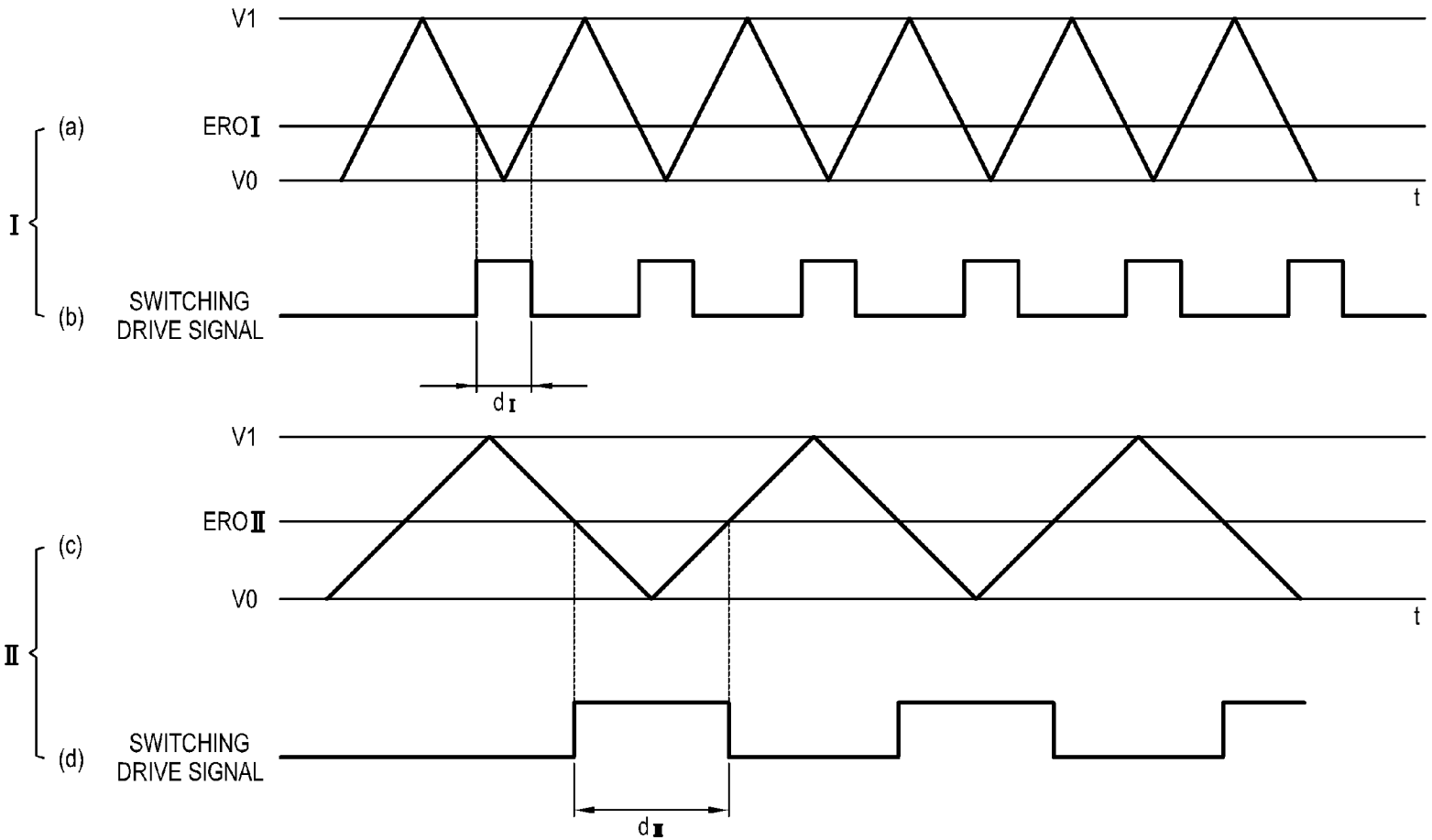
FIG. 4 is a waveform diagram for explaining a duty ratio of the backlight assembly in FIG. 1.

FIG. 3 is a circuit diagram for explaining a current change by the controller of FIG. 1, and FIG. 4 is a waveform diagram for explaining a duty ratio of the backlight assembly in FIG. 1. FIG. 3 illustrates the controller 240 and a partial internal circuit of the microcomputer U1 connected to the controller 240, in which a control current I1 is input from the controller 240 to the resistor terminal RT of the microcomputer U1. Other detailed circuits and internal structure of the microcomputer U1 are publicly known and descriptions thereof will be omitted.

The resistor terminal RT and the capacitor terminal CT are connected to each other, and a switch A is arranged between the resistor terminal RT and the capacitor terminal CT to adjust the current there between. Further, an operator B connected to a control terminal of the switch A serves to maintain a constant level of voltage applied to the resistor terminal RT. Since the resistor terminal RT always receives a predetermined voltage of 2V input to a non-inverting terminal of the operator B, the current I flowing in the resistor R201 is invariable. The current I2 flowing in the capacitor C206 is equal to a value obtained by subtracting the control current I1 from the current I flowing in the resistor R201. Thus, when the control current I1 is output from the controller 240, the current I2 flowing in the capacitor C206 decreases. In other words, if the feedback power is higher than the critical value and thus the second switch 243 is turned on, the current I2 flowing in the capacitor C206 decreases.

As described above, the capacitor C206 connected to the capacitor terminal CT and the resistor R201 connected to the resistor terminal RT participate in forming the triangle wave. The current I2 flowing in the capacitor C206 can be expressed by an equation: I2=C206*(dV/dt). Referring to this Equation, a differential in voltage with respect to a differential in time (dV/dt) decreases when the current I2 decreases, which means that the steepness of the triangle wave decreases.

Referring to FIG. 4, the triangle wave oscillates within certain voltage levels V0~V1 and has a frequency corresponding to on the drive frequency. In FIG. 4, (a) shows the triangle wave and the voltage level $ERO_I$ output from the feedback inverting terminal (ERO) in a first case I where the duty ratio is lower than an optimum value; (b) is the switching drive signal according to (a); (c) shows the triangle wave in a second case II where the control current I1 is input to the resistor terminal RT of the microcomputer U1; and (d) is the switching drive signal according to (c).

A turning-on period of the switching drive signal is determined depending on the triangle wave and the voltage level of the feedback inverting terminal ERO. The lower the steepness of the triangle wave or the higher the voltage level, the longer the period of time during which a switching drive unit is turned on. When the control current I1 is input to the resistor terminal RT, the steepness of the triangle wave more decreases than that of the first case I and thus the drive frequency decreases. As the drive frequency decreases, the power supplied to the light source unit 100 decreases, thereby decreasing the feedback power. The decrease in the feedback power corresponds to the increase in the level of the power of the feedback inverting terminal ERO. Therefore, the voltage level $ERO_{II}$ of the second case II is higher than the voltage level $ERO_I$ of the first case I. Through this causal sequence, the turning-on period $d_{II}$ of the switching drive signal in the second case II becomes longer than the turning-on period $d_I$ in the first case I. The increase in the turning-on period of the switching unit 220 causes the duty ratio to increase up to the optimum duty ratio, thereby decreasing the peak current. Consequently, the decrease of the drive frequency causes the duty ratio to increase, thereby reducing heat generation from the light source driver 200.

Figure 5:
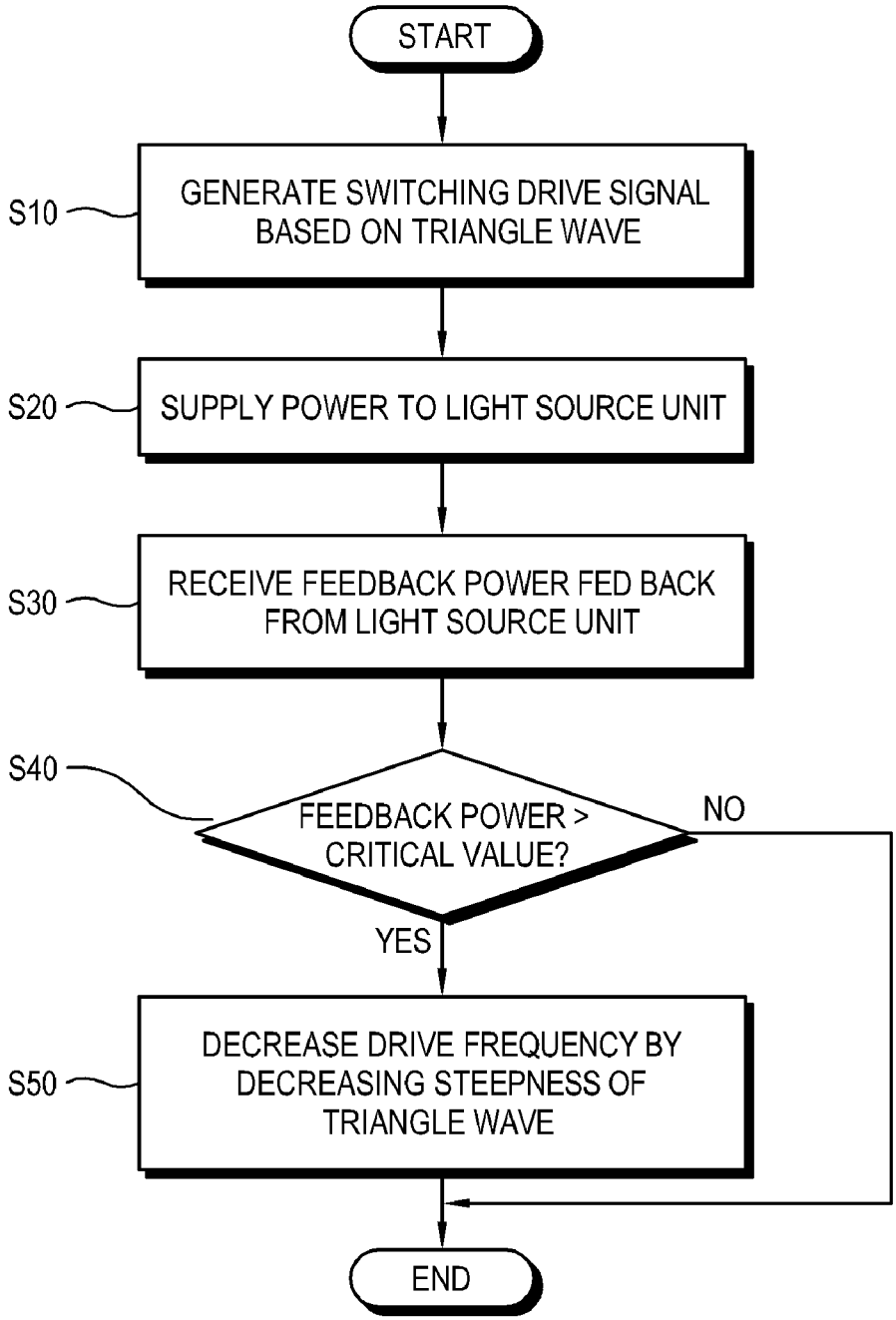
FIG. 5 is a flowchart for explaining a control method of the backlight assembly in FIG. 1.

FIG. 5 is a flowchart for explaining a control method of the backlight assembly in FIG. 1. Referring to FIG. 5, a method of adjusting the drive frequency according to an embodiment of the present invention is as follows.

First, the switching drive signal is generated using the triangle wave (S10), and the input power is supplied to the light source unit 100 on the basis of the switching drive signal (S20).

Then, the light source unit 100 feeds back the feedback power (S30). The feedback power informs characteristics of the light source unit 100 and the duty ratio of the switching drive signal corresponding to the characteristics of the light source unit 100. Depending on the feedback power, the first switch 241 and the second switch 243 are decided to be turned on or off.

The controller 240 determines whether or not the feedback power is higher than the critical value (S40). The critical value is set as a level of a voltage to be applied to the control terminal of the first switch 241 according to the resistances of the first and second resistors R1 and R2, and the determining is performed as the first switch 241 is turned on.

If the feedback power is higher than the critical value and thus the first switch 241 is turned off, the second switch 243 is turned on and thus the control current I1 is input to the drive signal generator 210. The control current I1 decreases the current I2 flowing in the capacitor C206 generating the triangle wave, thereby decreasing the steepness of the triangle wave (S50). As the steepness of the triangle wave decreases, the drive frequency decreases, thereby causing the duty ratio to increase. When the duty ratio increases, the peak current to be transferred from the primary coil to the secondary coil of the transformer 230 decreases, thereby reducing the heat generated in the transformer 230.

Figure 6:
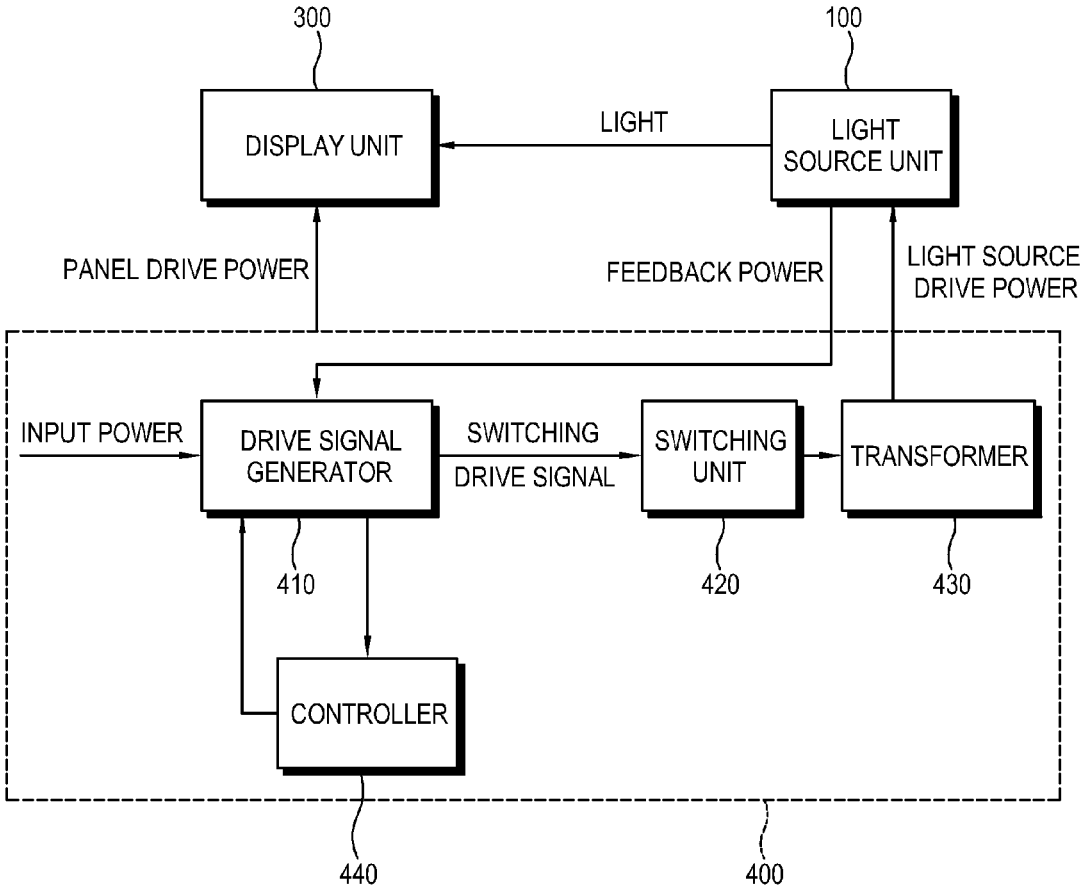
FIG. 6 is a control block diagram of a display apparatus according to a second exemplary embodiment of the present invention.

FIG. 6 is a control block diagram of a display apparatus according to a second exemplary embodiment of the present invention. As shown therein, the display apparatus includes a display unit 300, a light source unit 100 to illuminate the display unit 300, and a power supply 400 to supply power to the display unit 300 and the light source unit 100.

The display unit 300 may include a liquid crystal display (LCD) panel that needs a light source to display an image, and receives panel drive power from the power supply 400.

The light source unit 100 and components 410 to 440 of the power supply 400 are substantially equal or similar to those shown in FIG. 1, and repetitive descriptions thereof will be avoided as necessary. In the second exemplary embodiment, the power supply 400 may be an integrated power supply that converts alternating current (AC) power received from the outside into a plurality of direct current (DC) power different in a level, and supplies them to the display unit 300 and the light source unit 100. The power supply 400 may further include a switched-mode power supply (not shown). The power supply 400 optimizes a duty ratio of a switching drive signal in consideration of characteristics of the display unit 300 and the light source unit 100 which are connected to the power supply unit 400 and load. To this end, the power supply 400 determines the duty ratio of the switching drive signal on the basis of feedback power fed back from the light source unit 100, and decreases a drive frequency if the duty ratio is lower than the optimum value. The decrease of the drive frequency brings the increase of the duty ratio. When the duty ratio increases and thus has the optimum value, it is possible to reduce heat generated by the switching unit 420 and the transformer 430.

Thus, according to the embodiments of the present invention, the drive frequency and the duty ratio are adjusted by incorporating the characteristics of the display unit 300 and the light source 100, thereby reducing heat generated in the power supply.

As described above, the present invention to provide a backlight assembly improved in heat generation with low production costs, a display apparatus having the same, and a control method thereof.

Another aspect of the present invention is to provide a backlight assembly capable of easily optimizing a duty ratio of a switching drive signal, a display apparatus having the same, and a control method thereof.

Still another aspect of the present invention is to provide a backlight assembly improved in heat generation from a light source driver by easily adjusting a drive frequency, a display apparatus having the same, and a control method thereof.

Although a few exemplary embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A backlight assembly with a light source unit, comprising:

a drive signal generator which generates a switching drive signal on the basis of a predetermined drive frequency and a feedback power fed back from the light source unit;

a switching unit which outputs a power to the light source unit in response to the switching drive signal; and a controller which decreases the drive frequency if the feedback power is higher than a predetermined critical value, wherein the drive signal generator generates a triangle wave based on the drive frequency, the controller comprises a first switch turned off if the feedback power is higher than the critical value, and a second switch allowing a predetermined current to flow toward the drive signal generator by turning on if the first switch is turned off, and the current input to the drive signal generator decreases steepness of the triangle wave.

2. The backlight assembly according to claim 1, wherein the drive signal generator comprises a feedback inverting terminal through which the feedback power is inverted and output, and the first switch is connected to the feedback inverting terminal.

3. The backlight assembly according to claim 2, wherein the controller further comprises a plurality of voltage division resistors connected between the feedback inverting terminal and the first switch to determine a power level at which the first switch remains turned off.

4. The backlight assembly according to claim 2, wherein the feedback inverting terminal outputs power in inverse proportion to the feedback power.

5. The backlight assembly according to claim 1, wherein the controller further comprises a capacitor to turn on the second switch after a lapse of predetermined delay time after the first switch is turned off

6. The backlight assembly according to claim 1, wherein the controller further comprises a resistor to adjust a level of the current input to the drive signal generator.

7. A backlight assembly with a light source unit, comprising:

a drive signal generator which generates a switching drive signal having a duty ratio variable depending on a feedback power fed back from the light source unit;

a switching unit which outputs a power in response to the switching drive signal; and a controller which controls the drive signal generator to increase the duty ratio of the switching drive signal if the feedback power is higher than a predetermined critical value, wherein the drive signal generator comprises a capacitor to generate a triangle wave based on a predetermined drive frequency, and the controller increases the duty ratio of the switching drive signal by decreasing steepness of the triangle wave.

8. The backlight assembly according to claim 7, wherein the controller comprises a first switch turned off if the feedback power is higher than the critical value, and a second switch allowing a predetermined current to flow toward the drive signal generator by turning on if the first switch is turned off, and the current input to the drive signal generator decreases the steepness of the triangle wave.

9. A display apparatus comprising:

a display unit which displays an image;

a light source unit which illuminates the display unit; and a power supply which supplies power to the display unit and the light source unit, the power supply comprising a drive signal generator which generates a switching drive signal on the basis of a predetermined drive frequency and a feedback power fed back from the light source unit; a switching unit which outputs the power in response to the switching drive signal; and a controller which determines a duty ratio of the switching drive signal on the basis of the feedback power and decreases the drive frequency if the duty ratio of the switching drive signal is lower than an optimum value, wherein the drive signal generator generates a triangle wave based on the drive frequency, the controller comprises a first switch turned off if the feedback power is higher than the critical value, and a second switch allowing a predetermined current to flow toward the drive signal generator by turning on if the first switch is turned off, and the current input to the drive signal generator decreases steepness of the triangle wave.

10. The display apparatus according to claim 9, wherein the controller further comprises a plurality of voltage division resistors to determine a power level at which the first switch remains turned off

11. The display apparatus according to claim 10, wherein the controller further comprises a resistor to adjust a level of the current input to the drive signal generator.

12. The display apparatus according to claim 10, wherein the controller further comprises a capacitor to turn on the second switch after a lapse of predetermined delay time after the first switch is turned off.

13. A method of controlling a backlight assembly with a light source unit, the method comprising:

generating a switching drive signal using a triangle wave based on a predetermined drive frequency;

supplying power to the light source unit in response to the switching drive signal;

receiving a feedback power from the light source unit; and decreasing the drive frequency if the feedback power is higher than a predetermined critical value, wherein the decreasing the drive frequency comprises decreasing steepness of the triangle wave if the feedback power is higher than the critical value.

14. A display apparatus comprising:

a light source unit;

a drive signal generator which generates a switching drive signal on the basis of a predetermined drive frequency and a feedback power fed back from the light source unit;

a switching unit which outputs a power to the light source unit in response to the switching drive signal; and a controller which decreases the drive frequency if the feedback power is higher than a predetermined critical value, wherein the drive signal generator generates a triangle wave based on the drive frequency, the controller comprises a first switch turned off if the feedback power is higher than the critical value, and a second switch allowing a predetermined current to flow toward the drive signal generator by turning on if the first switch is turned off, and the current input to the drive signal generator decreases steepness of the triangle wave.

15. The display apparatus according to claim 14, wherein the drive signal generator comprises a feedback inverting terminal through which the feedback power is inverted and output, and the first switch is connected to the feedback inverting terminal.

16. The display apparatus according to claim 15, wherein the controller further comprises a plurality of voltage division resistors connected between the feedback inverting terminal and the first switch to determine a power level at which the first switch remains turned off.

17. The display apparatus according to claim 15, wherein the feedback inverting terminal outputs power in inverse proportion to the feedback power.

18. The display apparatus according to claim 14, wherein the controller further comprises a capacitor to turn on the second switch after a lapse of predetermined delay time after the first switch is turned off

19. The display apparatus according to claim 14, wherein the controller further comprises a resistor to adjust a level of the current input to the drive signal generator.

* * * * *